United States Patent [19]

Bishop

[11] 4,298,682

[45] Nov. 3, 1981

[54] PHOTOGRAPHIC ELEMENT HAVING OVERCOATING OF IONIC POLYESTER IN HYDROPHILIC COLLOID

[75] Inventor: John F. Bishop, Rochester, N.Y.

[73] Assignee: Eastman Kodak Company, Rochester, N.Y.

[21] Appl. No.: 174,421

[22] Filed: Aug. 1, 1980

[51] Int. Cl.[3] ..... G03C 1/76

[52] U.S. Cl. ..... 430/533; 430/212; 430/215; 430/236; 430/259; 430/531; 430/523; 430/950; 430/961

[58] Field of Search ..... 430/215, 212, 236, 259, 430/262, 533, 539, 531, 523, 950, 961

[56] References Cited

U.S. PATENT DOCUMENTS

| | | | |
|---|---|---|---|
| 3,053,662 | 9/1962 | Mackey et al. | 430/527 |
| 3,376,137 | 4/1968 | Farney | 430/215 |
| 3,591,379 | 7/1971 | Plakunov | 430/961 |
| 3,652,282 | 3/1972 | Land | 96/76 |
| 3,793,023 | 2/1974 | Land | 96/3 |
| 4,056,397 | 11/1977 | Krafft et al. | 96/77 |
| 4,097,282 | 6/1978 | Noonan et al. | 430/215 |
| 4,190,449 | 2/1980 | Naoi et al. | 430/961 |

*Primary Examiner*—Jack P. Brammer
*Attorney, Agent, or Firm*—H. E. Cole

[57] ABSTRACT

Two-sheet diffusion transfer assemblages, photographic elements and dye image-receiving elements are described wherein an overcoat layer is present on the photographic element or the dye image-receiving element superposed thereon. The overcoat layer comprises either silica or an ionic polyester in a hydrophilic colloid which prevents spontaneous delamination during the lamination period, yet permits satisfactory peel-apart afterwards.

11 Claims, No Drawings

PHOTOGRAPHIC ELEMENT HAVING OVERCOATING OF IONIC POLYESTER IN HYDROPHILIC COLLOID

This invention relates to photography, and more particularly to two-sheet photographic assemblages, photographic elements and dye image-receiving elements for diffusion transfer photography. An overcoat layer is present on the photographic element or the dye image-receiving element superposed thereon. The overcoat layer comprises either silica or a particular ionic polyester in a hydrophilic colloid. This overcoat layer prevents spontaneous delamination during the lamination period, yet permits satisfactory peel-apart afterwards.

In a two-sheet image transfer process, a photosensitive or donor element is employed along with a dye image-receiving element. The receiving element usually comprises a support having thereon a dye image-receiving layer. The donor element usually consists of a support having thereon photosensitive silver halide emulsion layers having associated therewith dye image-providing materials. The donor element may also have process control layers for terminating development after the required development has taken place. Such layers usually include one or more timing layers and a neutralizing layer.

In practice, the donor element is exposed, soaked in an activator or processing composition, and then laminated to the receiving element. An imagewise distribution of dye image-providing material from the donor diffuses to the receiving element. After a required period of time, the two elements are separated.

The physical parameters of this system are stringent. All layers of the donor and receiver must be uniformly coatable, be stable, and have good wet and dry adhesion. The donor element must retain physical integrity while soaking in a highly alkaline processing composition for ten seconds or more at elevated temperatures ranging up to 32° C. The donor element must uniformly unite with the surface of the receiving element and, after passage through processing rollers, remain tightly in contact with the receiver without external pressure for the time required to transfer the dye image. This processing time may exceed ten minutes at temperatures which may vary over a wide range. Finally, the donor and receiving element must be cleanly separable without appreciable effort and produce no surface distortion in the receiving element.

In order for all the above requirements to be met, a careful balance of components is required in both the donor and receiver elements. The adhesion requirements appear to be contradictory. Initially, a high degree of wet adhesion of the donor to the receiver is desired. The donor-receiver interface bond must be strong enough to withstand premature delamination from handling, bending and curl forces, and have complete and uniform contact for optimum dye transfer. However, when dye transfer is complete, low adhesion at the interface bond is desired for ease of separation. A not uncommon problem is that the force required to separate the donor and receiver elements is increased as the lamination time becomes longer.

The processing composition employed in such a process is a low-viscosity, aqueous, alkaline material. To minimize access time and give good physical characteristics, this processing composition contains no thickening agents or viscosity-increasing addenda which directly or indirectly aid in bonding the donor to the receiver element. On the contrary, use of such a low viscosity processing composition may be a substantial factor in promoting unwanted, premature separation of the donor from the receiver element.

It would be desirable to find a solution to this problem of premature separation (spontaneous delamination) of the donor from the receiving element which results in incomplete dye transfer, causing the receiving element to be useless. We have found in accordance with our invention that spontaneous delamination in a two-sheet photographic assemblage can be significantly reduced or eliminated.

In U.S. Pat. No. 4,097,282, various heat-activatable adhesive compositions are described for use in various photographic materials, including image transfer film units. These adhesive materials are similar to various ionic polyesters which is one of the components of one of the compositions of the overcoat layer useful in our invention. Neither the composition employed in our invention nor the results obtained therewith are described in this patent, however.

In U.S. Pat. No. 3,376,137, a stripping layer on a receiving element is described which comprises an ethylene/maleic anhydride copolymer. U.S. Pat. No. 4,056,397 relates to a graft polymer to temporarily bond together layers of a diffusion transfer material. U.S. Pat. Nos. 3,652,282 and 3,793,023 relate to a receiving element being prelaminated to a photosensitive element to form a weak bond. This bond is adapted to be ruptured upon application of a processing composition. The particular materials employed in our invention are not described in these patents, however.

In accordance with our invention, a photographic assemblage is provided which comprises:

(A) a photographic element comprising a support having thereon at least one photosensitive silver halide emulsion layer having associated therewith a dye image-providing material; and (B) a dye image-receiving element comprising a support having thereon a dye image-receiving layer, said receiving element being adapted to be superposed on said photographic element into face-to-face contact after exposure thereof;

the improvement wherein either said photographic element or said receiving element has thereon as the outermost layer an overcoat layer, said overcoat layer being located at the interface of said photographic element and said receiving element when said receiving element is superposed on said photographic element, said overcoat layer comprising either silica in a hydrophilic colloid at a ratio of 2:1 to 7:1, or an ionic polyester in a hydrophilic colloid at a ratio of 1:5 to 10:1, said polyester comprising recurring units of:

(I) a diol component which comprises:

(a) at least 50 mole percent of units derived from diols having the structures:

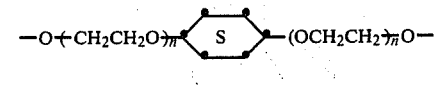

(i)

wherein n is an integer of from 1 to 4; and (ii) O(RO)m, wherein m is an integer of from 2 to 4, and R is an alkylene group of 2 to about 4 carbon atoms, such as ethylene, propylene, trimethylene, or tetramethylene; and (b) 0 to 50 mole percent of units derived from one or more diols having the structure:

$$-O-R^1-O-$$

wherein $R^1$ is an alkylene group of up to about 16 carbon atoms, such as ethylene, propylene, trimethylene, tetramethylene, hexamethylene, 1,12-dodecylene or 1,16-hexadecylene; a cyloalkylene group of 6 to about 20 carbon atoms, such as 1,3-cyclohexylene, 1,4-cyclohexylene, 2,3-norbornylene or 2,5(6)-norborylene; a cycloalkylenebisalkylene group of 8 to about 20 carbon atoms, such as 1,4-cyclohexylenedimethylene or 1,4-cyclohexylenediethylene; an arylenebisalkylene group of 8 to about 20 carbon atoms, such as 1,4-phenylenedimethylene or 1,4-phenylenediethylene; or an arylene group of 6 to about 12 carbon atoms, such as phenylene, tolylene or naphthylene; and (II) an acid component which comprises:

(a) 8 to 30 mole percent of units derived from one or more ionic dicarboxylic acids, said units having the structures:

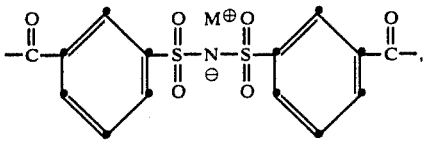

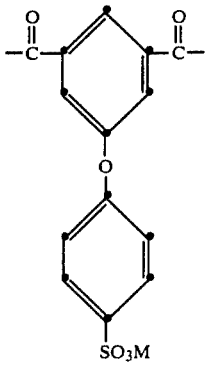

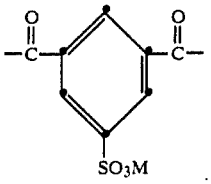

, and

-continued

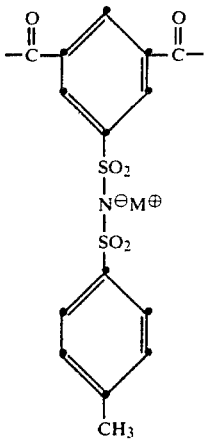

wherein M is ammonium (including tetraorganoammonium, such as tetramethylammonium or tetraethylammonium) or a monovalent metal, such as sodium, lithium or potassium; and (b) 70 to 92 mole percent of recurring units derived from other diacids.

In a preferred embodiment of our invention, the recurring units derived from the other diacids comprise one or more of the following:

(A) 0 to 80 mole percent of diacids selected from the group consisting of:

(I) aliphatic dicarboxylic acids, said units having the structure:

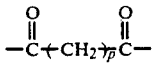

wherein p is an integer of from 2 to 12;

(II) cycloaliphatic diacids, said units having the structures:

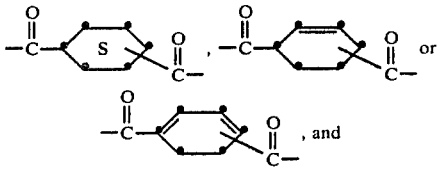

(III) aromatic diacids, said units having the structure:

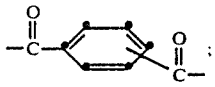

(B) 0 to 60 mole percent of recurring units having the structure:

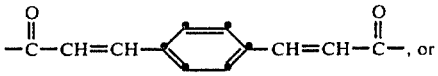

(C) 0 to 30 mole percent of recurring units derived from an alkylenebisamide, said units having the structure:

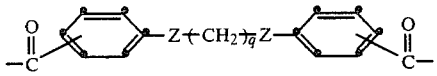

wherein each Z is iminocarbonyl or carbonylimino, and q is an integer of from 6 to 10.

Use of an overcoat of silica and a hydrophilic colloid or the particular polyester as described above and a hydrophilic colloid has been found useful in preventing spontaneous delamination during the lamination cycle. The use of these overcoats temporarily increases wet-adhesion during lamination, yet the bonding forces are sufficiently weak to prevent adhesive and/or cohesive forces within the donor and/or receiver element from preventing a clean and easy peel-apart at the desired time. The overcoats have no appreciable effect on image quality or imaging kinetics when used over a wide range of soak and lamination times and temperatures. When coated on the receiver, there is a minimal change in viewing surface characteristics. The polyester and silica compositions are easy to coat using conventional techniques.

When silica is employed as the overcoat, a high percentage of silica relative to the hydrophilic colloid is used. In general, good results have been obtained in ratios ranging from 2:1 to 7:1 (silica/hydrophilic colloid), with a ratio of 5:1 being preferred. In contrast to this concentration, a normal matte composition on a receiver with methacrylate beads and/or a low level of silica, such as 1:2 (silica/vehicle), is ineffective in preventing spontaneous delamination. The silica composition in accordance with our invention may be coated at any amount effective for the intended purpose. In general, good results have been obtained at coverages ranging from 0.54 to 1.9 g/m$^2$ of silica for 0.27 g/m$^2$ of hydrophilic colloid such as gelatin.

When the ionic polyester is employed as the overcoat, the ratio of polyester to hydrophilic colloid ranges from 1:5 to 10:1 as stated above, with a preferred range being from 3:1 to 5:1. The ionic polyester composition in accordance with our invention may be coated in any amount effective for the intended purpose. In general, good results have been obtained at coverages ranging from 0.27 to 2.6 g/m$^2$ of polyester for 0.27 g/m$^2$ of hydrophilic colloid such as gelatin.

The hydrophilic colloids useful in the overcoat composition can be selected from a wide variety of materials well known to those in the photographic art. Useful materials include gelatin, cellulose esters, dextran, gum arabic, casein or any of those materials described in *Research Disclosure,* December 1978, page 26, paragraph IX, A.

A photographic element in accordance with our invention comprises a support having thereon at least one photosensitive silver halide emulsion layer having associated therewith a dye image-providing material, and an overcoat layer as the outermost layer comprising the silica or polyester composition described above. In a preferred embodiment, a neutralizing layer and one or more timing layers are also employed and are located between the support and the silver halide emulsion layers.

A dye image-receiving element in accordance with our invention comprises a support having thereon a dye image-receiving layer and, as the outermost layer, an overcoat layer comprising the silica or polyester composition described above.

A process for producing a photographic image in accordance with our invention comprises immersing an exposed photographic element, as described above, in a processing composition, and then bringing the photographic element into face-to-face contact with a dye image-receiving element as described above. The overcoat layer is located either on the receiving element or the photographic element. The exposed photographic element can be immersed in the processing composition for periods of time ranging from 5 seconds to 30 seconds at temperatures from 15° C. to 32° C. to effect development of each of the exposed silver halide emulsion layers. The photographic element is then laminated to the dye image-receiving element by passing the two elements together in face-to-face contact through the nip of two rollers. The assemblage is then left laminated together for a period of time ranging from between 1 minute and 15 minutes. An imagewise distribution of dye image-providing material is thus formed as a function of development, and at least a portion of it diffuses to the dye image-receiving layer to provide the transfer image. The receiving element is then peeled apart from the photographic element. The image formed in the receiving element can be either a negative or a positive, depending upon whether or not the photosensitive emulsions employed in the donor element are negative emulsions or direct-positive emulsions, and depending on whether positive-working or negative-working image-forming chemistry is employed.

Generally, polyesters useful in the present invention are formed by condensing a glycol component of one or more polyhydric alcohols with an acid component of at least two carboxylic acids, each containing at least two condensation sites. It is noted that amido groups can be used as linking groups, rather than ester groups. This modification is readily achieved by condensing in the presence of amino alcohols or diamines. The carboxylic acids can be condensed in the form of a free acid or in the form of a functional derivative, such as an anhydride, a lower alkyl ester or an acid halide.

Exemplary diols which are utilized in preparing the condensation polyesters useful in this invention include 1,4-bis(2-hydroxyethoxy)cyclohexane, 1,4-bis(2-hydroxypropoxy)cyclohexane, 1,4-bis(2-hydroxybutoxy)cyclohexane, ethylene glycol, diethylene glycol, 1,3-propanediol, 1,4-butanediol, 1,5-pentanediol, 1,6-hexanediol, 1,7-heptanediol, 1,8-octanediol, neopentyl glycol, 2-ethyl-2-methyl-1,4-butane diol, 1,3-cyclohexane dimethanol, 1,4-cyclohexane dimethanol, triethylene glycol, tetraethylene glycol, 2,3-norbornanediol or 2,5(6)-norboranediol. The corresponding diamines can, if desired, be substituted for the diols in forming condensation copolymers useful in the present invention. One or a mixture of diols and/or diamines can be used, also.

Ionic dicarboxylic acids in the above formula are disclosed in U.S. Pat. No. 3,546,180 of Caldwell et al, issued Dec. 8, 1970, and U.S. Pat. No. 3,929,489 of Arcesi et al, issued Dec. 30, 1975, and in British Pat. No. 1,470,059, the disclosures of which are hereby incorporated by reference.

From about 70 to about 92 mole percent of the acid component of the polyesters useful in the present invention is derived from one or more other diacids or functional derivatives thereof. Exemplary of such diacids are aromatic dicarboxylic acids, such as phthalic acid, isophthalic acid or terephthalic acid; aliphatic dicarboxylic acids, such as malonic, succinic, glutaric, adipic, pimelic, suberic, azelaic, sebacic and other higher homolog dicarboxylic acids which may be aryl- or alkyl-substituted; cycloaliphatic dicarboxylic acids, such as 1,3-cyclohexanedicarboxylic acid, 1,4-cyclohexanedicarboxylic acid, 3,5-cyclohexenedicarboxylic acid, or 1,5-cyclohexa-1,3-dienedicarboxylic acid; light-sensitive ethylenically unsaturated dicarboxylic acids, such as p-phenylenebisacrylic acid, as disclosed in U.S. Pat. No. 3,929,489 of Arcesi et al.; alkylenebisamides, such as N,N'-bis(4-carboxyphenyl)-1,8-octanediamide and 1,6-bis(4-carboxyphenylcarbonylamino) hexane. Mixtures of these acids can be employed, if desired.

Polyesters preferred in the practice of this invention include:

Compound 1

Poly[1,4-cyclohexylenebis(oxyethylene)-co-1,4-cyclohexylenedimethylene (50:50) succinate-co-3,3'-(1,4-phenylene)bisacrylate-co-1,6-hexylenebis-(iminocarbonyl-4-benzoate)-co-3,3'-sodioiminodisulfonyldibenzoate (55:20:10:15)].

Compound 2

Poly[1,4-cyclohexylenebis(oxyethylene) succinate-co-3,3'-(1,4-phenylene)bisacrylate-co-1,6-hexylenebis-(iminocarbonyl-4-benzoate)-co-3,3'-sodioiminodisulfonyldibenzoate (55:20:10:15)].

Compound 3

Poly[1,4-cyclohexylenebis(oxyethylene) succinate-co-3,3'-(1,4-phenylene)bisacrylate-co-1,8-octylenebis(-carbonylimino-4-benzoate)-co-3,3'-sodioiminodisulfonyldibenzoate (55:20:10:15)].

Compound 4

Poly[1,4-cyclohexylenebis(oxyethylene) succinate-co-3,3'-(1,4-phenylene)bisacrylate-co-5-(4-sodiosulfophenoxy)-1,3-benzenedicarboxylate (15:55:30)].

Compound 5

Poly[1,4-cyclohexylenebis(oxyethylene) succinate-co-3,3'-(1,4-phenylene)bisacrylate-co-5-(4-sodiosulfophenoxy)-1,3-benzenedicarboxylate (45:40:15)].

Compound 6

Poly[1,4-cyclohexylenebis(oxyethylene) succinate-co-3,3'-(1,4-phenylene)bisacrylate-co-5-(4-sodiosulfophenoxy)-1,3-benzenedicarboxylate (60:10:30)].

Compound 7

Poly[1,4-cyclohexylenebis(oxyethylene) sebacate-co-3,3'-(1,4-phenylene)bisacrylate (80:20)].

Compound 8

Poly[1,4-cyclohexylenebis(oxyethylene)terephthalate-co-1-methyl-1-cyclohexene-4,5-dicarboxylate-co-5-(N-potassio-p-tolylsulfonamidosulfonyl)-1,3-benzenedicarboxylate (10:70:20)].

The condensate polyesters described herein can be prepared by procedures well known in the art for making linear condensation polymers, particularly interfacial, solution or ester interchange procedures, the latter being preferred. Reaction times are a function of all other variables and, as such, are governed by the inherent viscosity desired for the resulting polymer.

When employing interfacial procedures, polymerization is carried out in suitable halogenated solvents, such as methylene chloride, chloroform, dichloroethane, propylene dichloride and the like. Reaction temperatures are governed by maintenance of a practical rate of reaction and the boiling point of the solvent, with a range of 10° C. to 40° C. being suitable.

Solution polymerization procedures can be carried out by condensing suitable acid halides, such as chlorides, of the dicarboxylic acids to be incorporated with the desired diols in a suitable solvent, such as phenylenebis(acrylic acid chlorides), hexamethylenebis(4-iminocarbonylbenzoic acid chlorides) of sodioiminodisulfonyldibenzoic acid chlorides, in the presence of a suitable acid acceptor, such as pyridine, triethylamine or tripropylamine. The acid acceptor can be employed in excess to serve as the solvent.

The preferred mode of preparing the polyesters disclosed herein is the ester interchange procedure either by melt or powder process, and preferably by the melt process. The diols of the glycol component and the carboxylates of the acid component are heated to a melt on an approximately equal molar basis and treated with a transesterification catalyst, such as alkali or alkaline earth metal carbonates, oxides, hydroxides, hydrides and alkoxides; or compounds of a Group IVB metal of the Periodic Table, such as tetraisopropyl orthotitanate, butyl titanate, organo-metallic halides and complex alkoxides such as $NaHTi(OC_4H_9)_2$. As a practical matter, it is frequently desirable to utilize an excess of up to about 80 molar percent of the glycol component in the reaction mixture. Low boiling alcohols are removed by distillation during polymerization.

In general, it is desirable that the condensation copolymers described herein exhibit an inherent viscosity of from about 0.15 to about 0.90 and preferably from 0.2 to 0.8, as measured at 25° C. at a concentration of 0.25 grams per deciliter in a 1:1 mixture of phenol and chlorobenzene.

The dye image-providing material useful in our invention is either positive- or negative-working, and is either initially mobile or immobile in the photographic element during processing with an alkaline composition. Examples of initially mobile, positive-working dye image-providing materials useful in our invention are described in U.S. Pat. Nos. 2,983,606; 3,536,739; 3,705,184; 3,482,972; 2,756,142; 3,880,658 and 3,854,985. Examples of negative-working dye image-providing materials useful in our invention include conventional couplers which react with oxidized aromatic primary amino color developing agents to produce or release a dye such as those described, for example, in U.S. Pat. No. 3,227,550 and Canadian Pat. No. 602,607. In a preferred embodiment of our invention, the dye image-providing material is a ballasted, redox-dye-releasing (RDR) compound. Such compounds are well known to those skilled in the art and are, generally speaking, compounds which will react with oxidized or unoxidized developing agent or electron transfer agent to release a dye. Such nondiffusible RDR's include positive-working compounds, as described in U.S. Pat. Nos. 3,980,479; 4,139,379; 4,139,389; 4,199,354 and 4,199,355. Such nondiffusible RDR's also include negative-working compounds, as described in U.S. Pat. No. 3,728,113 of Becker et al; U.S. Pat. No. 3,725,062 of Anderson and Lum; U.S. Pat. No. 3,698,897 of Gompf and Lum; U.S. Pat. No. 3,628,952 of Puschel et al; U.S. Pat. No. 3,443,939 and U.S. Pat. No. 3,443,940 of Bloom et al;

U.S. Pat. No. 4,053,312 of Fleckenstein; U.S. Pat. No. 4,076,529 of Fleckenstein et al; U.S. Pat. No. 4,055,428 of Koyama et al; German Pat. Nos. 2,505,248 and 2,729,820; *Research Disclosure* 15157, November, 1976 and *Research Disclosure* 15654, April, 1977.

In a preferred embodiment of our invention, the dye-releasers such as those in the Fleckenstein et al patent referred to above are employed. Such compounds are ballasted sulfonamido compounds which are alkali-cleavable upon oxidation to release a diffusible dye from the nucleus and have the formula:

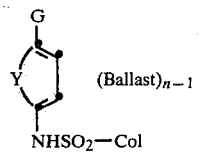

wherein:

(a) Col is a dye or dye precursor moiety;

(b) Ballast is an organic ballasting radical of such molecular size and configuration (e.g., simple organic groups or polymeric groups) as to render the compound nondiffusible in the photosensitive element during development in an alkaline processing composition;

(c) G is $OR^2$ or $NHR^3$ wherein $R^2$ is hydrogen or a hydrolyzable moiety and $R^3$ is hydrogen or a substituted or unsubstituted alkyl group of 1 to 22 carbon atoms, such as methyl, ethyl, hydroxyethyl, propyl, butyl, secondary butyl, tertiary butyl, cyclopropyl, 4-chlorobutyl, cyclobutyl, 4-nitroamyl, hexyl, cyclohexyl, octyl, decyl, octadecyl, docosyl, benzyl or phenethyl (when $R^3$ is an alkyl group of greater than 6 carbon atoms, it can serve as a partial or sole Ballast group);

(d) Y represents the atoms necessary to complete a benzene nucleus, a naphthalene nucleus or a 5- to 7-membered heterocyclic ring such as pyrazolone or pyrimidine; and (e) n is a positive integer or 1 to 2 and is 2 when G is $OR^2$ or when $R^3$ is a hydrogen or an alkyl group of less than 8 carbon atoms.

For further details concerning the above-described sulfonamido compounds and specific examples of same, reference is made to the above-mentioned Fleckenstein et al U.S. Pat. No. 4,076,529 referred to above.

In another preferred embodiment of our invention, positive-working, nondiffusible RDR's of the type disclosed in U.S. Pat. Nos. 4,139,379 and 4,139,389 are employed. In this embodiment, an immobile compound is employed which as incorporated in a photographic element is incapable of releasing a diffusible dye. However, during photographic processing under alkaline conditions, the compound is capable of accepting at least one electron (i.e., being reduced) and thereafter releases a diffusible dye. These immobile compounds are ballasted electron accepting nucleophilic displacement (BEND) compounds.

BEND compounds are ballasted compounds that undergo intramolecular nucleophilic displacement to release a diffusible moiety, such as a dye. They contain a precursor for a nucleophilic group which accepts at least one electron before the compound can undergo intramolecular nucleophilic displacement. In a preferred embodiment described in U.S. Pat. No. 4,139,379, the BEND compounds are processed in silver halide photographic elements with an electron transfer agent and an electron donor (i.e., a reducing agent) which provides the necessary electrons to enable the compound to be reduced to a form which will undergo intramolecular nucleophilic displacement. In this embodiment, the BEND compound reacts with the electron donor to provide a nucleophilic group which in turn enters into an intramolecular nucleophilic displacement reaction to displace a diffusible dye from the compound. However, where there are no electrons transferred to the electron accepting nucleophilic precursor, it remains incapable of displacing the diffusible dye. An imagewise distribution of electron donor is obtained in the photographic element by oxidizing the electron donor in an imagewise pattern before it has reacted with the BEND compound, leaving a distribution of unoxidized electron donor available to transfer electrons to the BEND compound. An imagewise distribution or oxidized electron donor is provided by reaction of the electron donor with an imagewise distribution of oxidized electron transfer agent, which in turn is obtained by reaction of a uniform distribution of electron transfer agent with an imagewise pattern of developable silver halide.

Thus, in processing an imagewise-exposed photographic element containing a BEND compound, the following reactions lead to an imagewise distribution of diffusible dye: In exposed areas, developable silver halide is developed by electron transfer agent, thereby providing oxidized electron transfer agent which reacts with and oxidizes electron donor, thus preventing it from reacting with BEND compound. In unexposed areas, there is no developable silver halide and, hence, neither electron transfer agent nor electron donor are oxidized. Thus, electron donor reacts with BEND compound to release diffusible dye.

The film unit or assemblage of the present invention is used to produce positive images in single or multicolors. In a three-color system, each silver halide emulsion layer of the film assembly will have associated therewith a dye image-providing material which possesses a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith and the red-sensitive silver halide emulsion layer will have a cyan dye image-providing material associated therewith. The dye image-providing material associated with each silver halide emulsion layer is contained either in the silver halide emulsion layer itself or in a layer contiguous to the silver halide emulsion layer, i.e., the dye image-providing material can be coated in a separate layer underneath the silver halide emulsion layer with respect to the exposure direction.

The concentration of the dye image-providing material that is employed in the present invention can be varied over a wide range, depending upon the particular compound employed and the results desired. For example, the dye image-providing material coated in a layer at a concentration of 0.1 to 3 g/m$^2$ has been found to be useful. The dye image-providing material is dispersed in a hydrophilic film forming natural material or synthetic polymer, such as gelatin or polyvinyl alcohol, which is adapted to be permeated by aqueous alkaline processing composition.

A variety of silver halide developing agents are useful in this invention. Specific examples of developers or electron transfer agents (ETA) compounds useful in this invention include hydroquinone compounds, such as hydroquinone, 2,5-dichlorohydroquinone or 2-chlorohydroquinone; aminophenol compounds, such as 4-aminophenol, N-methylaminophenol, N,N-dimethylaminophenol, 3-methyl-4-aminophenol or 3,5-dibromoaminophenol; catechol compounds, such as catechol, 4-cyclohexylcatechol, 3-methoxycatechol or 4-(N-octadecylamino)catechol; phenylenediamine compounds, such as N,N-diethyl-p-phenylenediamine, 3-methyl-N,N-diethyl-p-phenylenediamine, 3-methoxy-N-ethyl-N-ethoxy-p-phenylenediamine or N,N,N',N'-tetramethyl-p-phenylenediamine. In highly preferred embodiments, the ETA is a 3-pyrazolidinone compound, such as 1-phenyl-3-pyrazolidinone (Phenidone), 1-phenyl-4,4-dimethyl-3-pyrazolidinone (Dimezone), 4-hydroxymethyl-4-methyl-1-phenyl-3-pyrazolidinone, 4-hydroxymethyl-4-methyl-1-p-tolyl-3-pyrazolidinone, 4-hydroxymethyl-4-methyl-1-(3,4-dimethylphenyl)-3-pyrazolidinone, 1-m-tolyl-3-pyrazolidinone, 1-p-tolyl-3-pyrazolidinone, 1-phenyl-4-methyl-3-pyrazolidinone, 1-phenyl-5-methyl-3-pyrazolidinone, 1-phenyl-4,4-dihydroxymethyl-3-pyrazolidinone, 1,4-dimethyl-3-pyrazolidinone, 4-methyl-3-pyrazolidinone, 4,4-dimethyl-3-pyrazolidinone, 1-(3-chlorophenyl)-4-methyl-3-pyrazolidinone, 1-(4-chlorophenyl)-4-methyl-3-pyrazolidinone, 1-(3-chlorophenyl)-3-pyrazolidinone, 1-(4-chlorophenyl)-3-pyrazolidinone, 1-(4-tolyl)-4-methyl-3-pyrazolidinone, 1-(2-tolyl)-4-methyl-3-pyrazolidinone, 1-(4-tolyl)-3-pyrazolidinone, 1-(3-tolyl)-3-pyrazolidinone, 1-(3-tolyl)-4,4-dimethyl-3-pyrazolidinone, 1-(2-trifluoroethyl)-4,4-dimethyl-3-pyrazolidinone or 5-methyl-3-pyrazolidinone. A combination of different ETA's, such as those disclosed in U.S. Pat. No. 3,039,869, can also be employed. While such developing agents may be employed in the liquid processing composition, we have obtained good results when the ETA is incorporated in a layer or layers of the photographic element or receiving element to be activated by the alkaline processing composition, such as in the silver halide emulsion layers, the dye image-providing material layers, interlayers, or the image-receiving layer.

In using dye image-providing materials in the invention which produce diffusible dye images as a function of development, either conventional negative-working or direct-positive silver halide emulsions are employed. If the silver halide emulsion employed is a direct-positive silver halide emulsion, such as an internal image emulsion designed for use in the internal image reversal process, or a fogged, direct-positive emulsion such as a solarizing emulsion, which is developable in unexposed areas, a positive image can be obtained on the dye image-receiving layer by using ballasted, redox, dye-releasers. After exposure of the film unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the dye-releasing compounds and the oxidized form of the compounds then undergoes a base-catalyzed reaction to release the dyes imagewise as a function of the imagewise exposure of each of the silver halide emulsion layers. At least a portion of the imagewise distributions of diffusible dyes diffuse to the image-receiving layer to form a positive image of the original subject.

Internal image silver halide emulsions useful in this invention are described more fully in the November, 1976 edition of *Research Disclosure,* pages 76 through 79, the disclosure of which is hereby incorporated by reference.

The various silver halide emulsion layers of a color film assembly employed in this invention are disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

Generally speaking, except where noted otherwise, the silver halide emulsion layers employed in the invention comprise photosensitive silver halide dispersed in gelatin and are about 0.6 to 6 microns in thickness; the dye image-providing materials are dispersed in an aqueous alkaline solution-permeable polymeric binder, such as gelatin, as a separate layer about 0.2 to 7 microns in thickness; and the alkaline solution-permeable polymeric interlayers, e.g., gelatin, are about 0.2 to 5 microns in thickness. Of course, these thicknesses are approximate only and can be modified according to the product desired.

Any material is useful as the dye image-receiving layer in this invention, as long as the desired function of mordanting or otherwise fixing the dye images is obtained. The particular material chosen will, of course, depend upon the dye to be mordanted. Suitable materials are disclosed on pages 80 through 82 of the November, 1976 edition of *Research Disclosure,* the disclosure of which is hereby incorporated by reference.

Use of a neutralizing layer in the film assemblages of this invention is usually employed to increase the stability of the transferred image. Generally, the neutralizing material will effect a reduction in the pH of the image layer from about 13 or 14 to at least 11, and preferably 5 to 8 within about three minutes after imbibition. Suitable materials and their functions are disclosed on pages 22 and 23 of the July, 1974 edition of *Research Disclosure,* and pages 35 through 37 of the July, 1975 edition of *Research Disclosure,* the disclosures of which are hereby incorporated by reference.

One or more timing or inert spacer layers can be employed in the practice of this invention over the neutralizing layer which "times" or controls the pH reduction as a function of the rate at which the alkaline composition diffuses through the inert spacer layer or layers. Examples of such timing layers and their functions are disclosed in the *Research Disclosure* articles mentioned in the paragraph above concerning pH-lowering layers.

The above-described acid layers and timing layers together constitute process control layers for "shutting down" the system after the required development has taken place. These process control layers are located either in the donor element or in the receiving element, as desired.

The alkaline processing or activating composition employed in this invention is the conventional aqueous solution of an alkaline material, e.g., alkali metal hydroxides or carbonates such as sodium hydroxide, sodium carbonate or an amine such as diethylamine, preferably possessing a pH in excess of 11. In some embodiments of the invention, the processing composition may contain a developing agent. Suitable materials and addenda frequently added to such compositions are disclosed on pages 79 and 80 of November, 1976 edition of *Research Disclosure,* the disclosure of which is hereby incorporated by reference.

The supports for the photographic element and receiving element used in this invention can be any material, as long as it does not deleteriously affect the photographic properties and is dimensionally stable. Typical flexible sheet materials are described on page 85 of the November, 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dotes of blue-, green- and red-sensitive emulsions have associated therewith, respectively, dots of yellow, magenta and cyan color-providing substances. After development, the transferred dyes would tend to fuse together into a continuous tone.

The silver halide emulsions useful in this invention, both negative-working and direct-positive ones, are well known to those skilled in the art and are described in *Research Disclosure,* Volume 176, December, 1978, Item 17643, pages 22 and 23, "Emulsion preparation and types"; they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the active article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference.

The term "nondiffusing" used herein has the meaning commonly applied to the term in photography and denotes materials that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers, so long as the materials are accessible to one another.

The following examples are provided to further illustrate the invention.

EXAMPLE 1

Overcoat on Photosensitive Element (A) A control photosensitive (donor) element is prepared by coating the following layers in the order recited on an opaque poly(ethylene terephthalate) film support:

(1) Polymeric acid layer
(2) Timing layer
(3) Cyan redox dye-releaser layer
(4) Red-sensitive, negative-working, silver halide emulsion layer
(5) Interlayer with incorporated developer
(6) Magenta redox dye-releaser layer
(7) Green-sensitive, negative-working, silver halide emulsion layer
(8) Interlayer with incorporated developer
(9) Yellow redox dye-releaser layer
(10) Blue-sensitive, negative-working, silver halide emulsion layer
(11) Matte overcoat layer The polymeric acid layer and timing layer are similar to those described in the examples of Abel U.S. Application Ser. No. 948,062, filed Oct. 2, 1978, now U.S. Pat. No. 4,229,516. The redox dye-releasers are similar to those described in *Research Disclosure* No. 18268, Volume 182, July, 1979, pages 329 through 331. The silver halide emulsion layers are conventional negative-working, 0.25 to 0.65$\mu$ silver chloride emulsions. The incorporated developer is a 3-position blocked 1-phenyl-3-pyrazolidinone. The matte overcoat layer comprises gelatin (0.89 g/m$^2$), methacrylate beads (2–4$\mu$, 0.017 g/m$^2$), Ludox AM TM silica (particle size about 0.2$\mu$, 0.45 g/m$^2$) and 2,5-didodecylhydroquinone (0.38 g/m$^2$). The total gelatin coverage in layers 3 to 11 is 8.1 g/m$^2$, hardened with 0.75 percent bis(vinylsulfonyl)-methyl ether.

(B) A sample of the above donor was then overcoated with 0.81 g/m$^2$ of polyester Compound 1 plus 0.27 g/m$^2$ gelatin.

(C) A sample of donor (A) was then overcoated with 1.4 g/m$^2$ of Ludox AM TM silica, plus 0.27 g/m$^2$ gelatin. The Ludox AM TM silica is manufactured by du-Pont and is described as 15 m$\mu$ colloidal silica (30 percent solids by weight); the particles are surface-modified with aluminum; the stabilizing counter ion is sodium.

A dye image-receiving element was then prepared by coating the following layers in the order recited on an opaque paper support:

(1) Dye image-receiving layer of poly(1-vinyl-2-methylimidazole) (3.2 g/m$^2$) gelatin (1.1 g/m$^2$), sorbitol (0.27 g/m$^2$) and formaldehyde (0.05 g/m$^2$)

(2) Interlayer of gelatin (0.86 g/m$^2$), ultraviolet absorber 2-(2-hydroxy-3,5-di-t-amylphenyl)benzotriazole (0.54 g/m$^2$) and formaldehyde (0.05 g/m$^2$)

(3) Overcoat of gelatin (0.65 g/m$^2$)

The total amount of gelatin in these layers was 2.6 g/m$^2$, nardened with formaldehyde.

An activator solution was prepared containing:

| | |
|---|---|
| Potassium hydroxide | 0.6 N |
| 5-Methylbenzotriazole | 3.0 g/l |
| 11-Aminoundecanoic acid | 2.0 g/l |
| Potassium bromide | 2.0 g/l |

Samples of the above donor elements were flashed to maximum density, soaked in the activator solution above contained in a shallow-tray processor for 15 seconds at 28° C., and then laminated between nip rollers to dry samples of the receiving element. After 10 minutes, the donor and receiver were pulled apart. Areas in the receiver where delamination has occurred, resulting in no or lesser amounts of transferred dye are observed visually.

Other samples were evaluated for peel force required to separate the donor from the receiver on an Instron Tensile Testing Machine. The peel force is measured at specific times. The following results were obtained:

TABLE I

| Donor | Overcoat | Observation of Dye Transfer | Instron Peel Force (grams) Minutes After Lamination 0.5 | 1 | 3 | 10 |
|---|---|---|---|---|---|---|
| A (control) | None | Extensive areas show no dye or a lesser amount of dye transferred | 3.5 | 4 | 9 | 9 |
| B | Polyester Compound 1 and Gelatin | Virtually no areas of failure to transfer dye | 9.5 | 20 | 57 | 26 |
| C | Silica and Gelatin | Virtually no areas of failure to transfer dye | 9.5 | 17 | 92 | 11 |

The above results indicate that use of the overcoats in accordance with our invention significantly reduces spontaneous delamination. The peel force at 10 minutes is also substantially less than the peel force at 3 minutes for the film assemblages of our invention, in comparison to the control which has the same value for both time periods.

EXAMPLE 2

Overcoat on Receiver (A) A dye image-receiving element was prepared by coating the following layers in the order recited on an opaque paper support:

(1) Dye image-receiving layer of poly-1-vinyl-2-methylimidazole (3.2 g/m$^2$), gelatin (1.1 g/m$^2$), sorbitol (0.27 g/m$^2$) and formaldehyde (0.05 g/m$^2$)

(2) Interlayer of gelatin (0.86 g/m$^2$), ultraviolet absorber 2-(2-hydroxy-3,5-di-t-amylphenyl)benzotriazole (0.54 g/m$^2$) and formaldehyde (0.05 g/m$^2$)

(3) Overcoat layer of gelatin (0.65 g/m$^2$)

(B) A sample of the dye image-receiving element of (A) is overcoated with 0.81 g/m$^2$ of polyester Compound I, plus 0.27 g/m$^2$ gelatin.

(C) A sample of the dye image-receiving element of (A) is overcoated with 0.27 g/m$^2$ of polyester Compound I, plus 0.81 g/m$^2$ of gelatin.

(D) A sample of the dye image-receiving element of (A) is overcoated with 1.4 g/m$^2$ of Ludox AM TM silica, plus 0.27 g/m$^2$ gelatin.

Samples of the exposed control donor of Example 1 are processed as in Example 1 and laminated to the above receiver. After lamination to the receiver, the frequency (via multiple tests) for which spontaneous delamination (separation of donor and receiver) occurred was estimated as follows:

TABLE II

| Receiver | Overcoat Layer | Donor/Receiver Spontaneous Delamination Frequency |
|---|---|---|
| A (control) | None | 100% |
| B | Polyester and gelatin | 33% |
| C | Polester and gelatin | 33% |
| D | Silica and gelatin | 33% |

The above results indicate that use of the overcoats in accordance with our invention significantly reduces spontaneous delamination in comparison to the control.

EXAMPLE 3

Overcoat on Photosensitive Element

The experimental procedure of Example 1 using the Instron Tensile Testing Machine was repeated, except that Compounds 4, 5, 6, 7 and 8 of the invention were employed in the amounts listed in Table III below instead of Compound 1. Gelatin was employed in each overcoat at a coverage of 0.27 g/m$^2$. The following results were obtained:

TABLE III

| Overcoat Polyester | Coverage (g/m$^2$) | Instron Peel Force (grams) Minutes After Lamination 0.5 | 1 |
|---|---|---|---|
| None (control) | | 6 | 6 |
| Compound 4 | 0.81 | 8 | 9 |
| Compound 5 | 0.81 | 24 | 29 |
| Compound 6 | 0.81 | 8 | 9 |
| Compound 7 | 0.81 | 21 | 25 |
| Compound 7 | 1.4 | 48 | 64 |
| Compound 8 | 0.43 | 15 | 20 |
| Compound 8 | 0.81 | 31 | 39 |

The above results again demonstrate that use of the overcoats in accordance with our invention significantly reduces spontaneous delamination. The greater adhesion is desirable, provided that it is not so great that the donor and receiver cannot be separated. None of the experiments exhibited the latter.

The invention has been described in detail with particular reference to preferred embodiments thereof, but it will be understood that variations and modifications can be effected within the spirit and scope of the invention.

What is claimed is:

1. In a photographic element comprising a support having thereon at least one photosensitive silver halide emulsion layer having associated therewith a dye image-providing material, the improvement wherein said element has, over said emulsion layer, an overcoat layer comprising an ionic polyester in a hydrophilic colloid at a weight ratio of 1:5 to 10:1, said polyester comprising recurring units of:

(I) a diol component which comprises:

(a) at least 50 mole percent of units derived from diols having the structures:

(i)

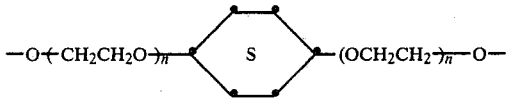

wherein n is an integer of from 1 to 4; and (ii) O—(RO)—$_m$, wherein m is an integer of from 2 to 4, and R is an alkylene group of 2 to about 4 carbon atoms; and (b) 0 to 50 mole percent of units derived from one or more diols having the structure:

$$-O-R^1-O-$$

wherein $R^1$ is an alkylene group of up to about 16 carbon atoms, a cycloalkylene group of 6 to about 20 carbon atoms, a cycloalkylenebisalkylene group of 8 to about 20 carbon atoms, an arylenebisalkylene group of 8 to about 20 carbon atoms, or an arylene group of 6 to about 12 carbon atoms; and (II) an acid component which comprises:

(a) 8 to 30 mole percent of units derived from one or more ionic dicarboxylic acids, said units having the structures:

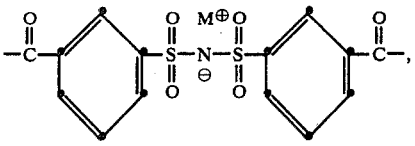

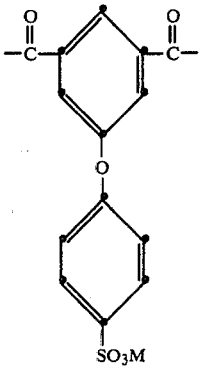

, and

-continued

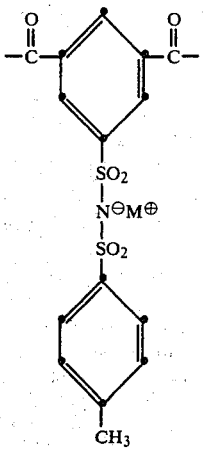

wherein M is ammonium or a monovalent metal; and (b) 70 to 92 mole percent of recurring units derived from other diacids.

2. The photographic element of claim 1 wherein said recurring units derived from said other diacids comprise one or more of the following:

(A) 0 to 80 mole percent of diacids selected from the group consisting of:

(I) aliphatic dicarboxylic acids, said units having the structure:

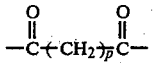

wherein p is an integer of from 2 to 12;

(II) cycloaliphatic diacids, said units having the structures:

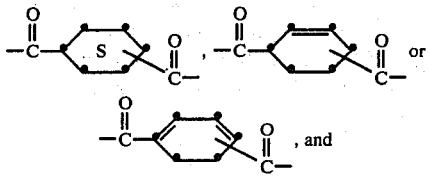

(III) aromatic diacids, said units having the structure:

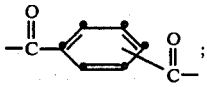

(B) 0 to 60 mole percent of recurring units having the structure:

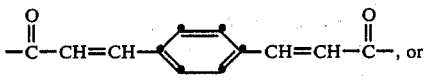

(C) 0 to 30 mole percent of recurring units derived from an alkylenebisamide, said units having the structure:

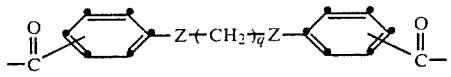

wherein each Z is iminocarbonyl or carbonylimino, and q is an integer of from 6 to 10.

3. The photographic element of claim 1 wherein said hydrophilic colloid is gelatin.

4. The photographic element of claim 1 wherein said overcoat layer comprises poly[1,4-cyclohexylenebis(oxyethylene)-co-1,4-cyclohexylenedimethylene (50:50) succinate-co-3,3'-(1,4-phenylene)bisacrylate-co-1,6-hexylenebis(iminocarbonyl-4-benzoate)-co-3,3'-sodioiminodisulfonyldibenzoate (55:20:10:15)];

poly[1,4-cyclohexylenebis(oxyethylene) succinate-co-3,3'-(1,4-phenylene)bisacrylate-co-1,6-hexylenebis-(iminocarbonyl-4-benzoate)-co-3,3'-sodioiminodisulfonyldibenzoate (55:20:10:15)];

poly[1,4-cyclohexylenebis(oxyethylene) succinate-co-3,3'-(1,4-phenylene)bisacrylate-co-1,8-octylenebis(-carbonylimino-4-benzoate)-co-3,3'-sodioiminodisulfonyldibenzoate (55:20:10:15)];

poly[1,4-cyclohexylenebis(oxyethylene) succinate-co-3,3'-(1,4-phenylene)bisacrylate-co-5-(4-sodiosulfophenoxy)-1,3-benzenedicarboxylate (15:55:30)];

poly[1,4-cyclohexylenebis(oxyethylene) succinate-co-3,3'-(1,4-phenylene)bisacrylate-co-5-(4-sodiosulfophenoxy)-1,3-benzenedicarboxylate (45:40:15)];

poly[1,4-cyclohexylenebis(oxyethylene) succinate-co-3,3'-(1,4-phenylene)bisacrylate-co-5-(4-sodiosulfophenoxy)-1,3-benzenedicarboxylate (60:10:30)];

poly[1,4-cyclohexylenebis(oxyethylene) sebacate-co-3,3'-(1,4-phenylene)bisacrylate (80:20)]; or poly[1,4-cyclohexylenebis(oxyethylene) terephthalate-co-1-methyl-1-cyclohexene-4,5-dicarboxylate-co-5-(N-potassio-p-tolylsulfonamidosulfonyl)-1,3-benzenedicarboxylate (10:70:20)].

5. The photographic element of claim 1 wherein said dye image-providing material is a ballasted, redox dye-releaser.

6. The photographic element of claim 1 wherein said dye image-providing material is a ballasted sulfonamido compound which is alkali-cleavable upon oxidation to release a diffusible color-providing moiety, said compound having the formula:

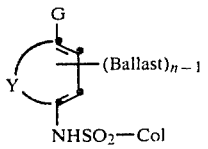

wherein:

(a) Col is a dye or dye precursor moiety;

(b) Ballast is an organic ballasting radical of such molecular size and configuration as to render said compound nondiffusible in the photosensitive element during development in an alkaline processing composition;

(c) G is $OR^2$ or $NHR^3$ wherein $R^2$ is hydrogen or a hydrolyzable moiety and $R^3$ is hydrogen or an alkyl group of 1 to 22 carbon atoms;

(d) Y represents the atoms necessary to complete a benzene nucleus, a naphthalene nucleus or a 5- to 7-membered heterocyclic ring; and (e) n is a positive integer of 1 to 2 and is 2 when G is $OR^2$ or when $R^3$ is a hydrogen or an alkyl group of less than 8 carbon atoms.

7. The photographic element of claim 6 wherein G is OH, n is 2 and Y is a naphthalene nucleus.

8. The photographic element of claim 1 wherein said silver halide emulsion is a direct-positive silver halide emulsion.

9. The photographic element of claim 1 wherein said dye image-providing material is a ballasted, electron-accepting nucleophilic displacement compound.

10. The photographic element of claim 1 wherein a neutralizing layer and a timing layer are located between said support and said silver halide emulsion layer, said neutralizing layer being located adjacent said support.

11. In a photographic element comprising a support having thereon, in order, a neutralizing layer, a timing layer, a red-sensitive silver halide emulsion layer having associated therewith a cyan dye image-providing material, a green-sensitive silver halide emulsion layer having associated therewith a magenta dye image-providing material, and a blue-sensitive silver halide emulsion layer having associated therewith a yellow dye image-providing material, the improvement wherein said element has, over said blue-sensitive emulsion layer, an overcoat layer comprising an ionic polyester in a hydrophilic colloid at a weight ratio of 1:5 to 10:1, said polyester comprising recurring units of:

(I) a diol component which comprises:

(a) at least 50 mole percent of units derived from diols having the structures:

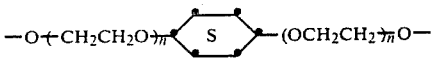

(i)

wherein n is an integer of from 1 to 4; and (ii) O—(RO)—$_m$, wherein m is an integer of from 2 to 4, and R is an alkylene group of 2 to about 4 carbon atoms; and (b) 0 to 50 mole percent of units derived from one or more diols having the structure:

—O—$R^1$—O— wherein $R^1$ is an alkylene group of up to about 16 carbon atoms, a cycloalkylene group of 6 to about 20 carbon atoms, a cycloalkylenebisalkylene group of 8 to about 20 carbon atoms, an arylenebisalkylene group of 8 to about 20 carbon atoms, or an arylene group of 6 to about 12 carbon atoms; and (II) an acid component which comprises:

(a) 8 to 30 mole percent of units derived from one or more ionic dicarboxylic acids, said units having the structures:

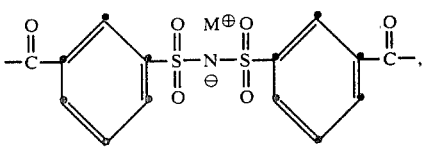

-continued
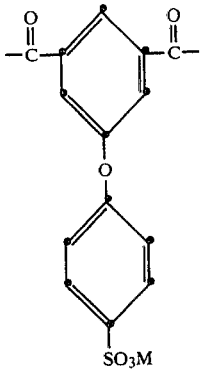
,
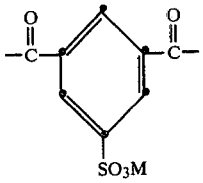
, and
-continued
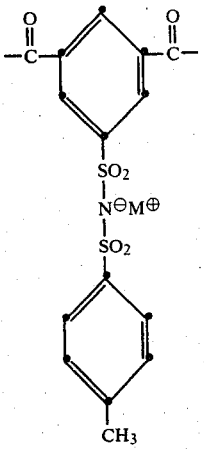
wherein M is ammonium or a monovalent metal; and
(b) 70 to 92 mole percent of recurring units derived from other diacids.
* * * * *